US005823009A

United States Patent [19]

Suzuki et al.

[11] Patent Number: 5,823,009

[45] Date of Patent: Oct. 20, 1998

[54] BLOWOFF ORIFICE

[75] Inventors: Tomoko Suzuki; Takayuki Yoshida; Satoru Kotoh; Hiroaki Ishikawa; Kazunobu Jojima; Itsutarou Akiyama; Akihiro Matsushita; Masataka Kabuki, all of Tokyo, Japan

[73] Assignee: Mitsubishi Denki Kabushiki Kaisha, Tokyo, Japan

[21] Appl. No.: 740,708

[22] Filed: Nov. 1, 1996

[30] Foreign Application Priority Data

Nov. 20, 1995 [JP] Japan ..... 7-310456

[51] Int. Cl.[6] ..... F24F 13/08

[52] U.S. Cl. ..... 62/410; 62/411; 454/305

[58] Field of Search ..... 62/404, 408, 409, 62/410, 411–419, 426, 262; 454/305, 333, 319, 326

[56] References Cited

U.S. PATENT DOCUMENTS 4,266,722 5/1981 Nawa et al. ..... 454/305

4,556,172 12/1985 Sugawara et al. ..... 239/590.5

FOREIGN PATENT DOCUMENTS 354033350 3/1979 Japan ..... 454/305

405187709 7/1993 Japan ..... 454/333

6-70519 7/1994 Japan .

2293447 3/1996 United Kingdom .

*Primary Examiner*—William Doerrler

*Attorney, Agent, or Firm*—Wolf, Greenfield & Sacks, P.C.

[57] ABSTRACT

A blowoff orifice is constituted by an upper wall, a lower wall and a vertical wind deflecting plate. The upper wall inclines so that a flow passage becomes narrow toward downstream and provided with a protrusion at its end portion. The lower wall has a horizontal linear portion on the downstream side and an end portion forming an acute angle at the tip of the linear portion. The vertical wind deflecting plate is provided between the upper wall and the lower wall, and capable of changing an airflow from a horizontal direction to a downward direction. The upper wall protrusion is located more downstream than the lower wall end portion.

20 Claims, 13 Drawing Sheets

PRIOR ART

BLOWOFF ORIFICE

BACKGROUND OF THE INVENTION

1. Field of the Invention

The present invention relates to the structure of a blowoff orifice for controlling blown-off air used for an air conditioning system and the like.

2. Description of the Related Art

FIG. 23 is a sectional view of a ceiling hanging type air conditioner disclosed in Examined Japanese Patent Publication No. 6-70519 showing the conventional blowoff orifice. In FIG. 23, reference numeral 1 denotes an air conditioner body whose interior is partitioned into a blower chamber 52 and a heat exchanging chamber 53 by a partition plate 51. Within the blower chamber 52 are provided a fan casing 54 incorporating a blowoff orifice 2 and a sirocco fan (not shown) and a motor 6 for driving the fan. Within the heat exchanging chamber 53 are provided a heat exchanger 11 supported by a side plate 55 (another side plate opposed thereto is not shown) and a drain pan 90 below the heat exchanger. On the front of the body 1, a blowoff orifice 30 provided with a wind deflecting device is arranged. The upper portion of the blowoff orifice 30 includes a ceiling plate 56 with its tip bent in a U-shape, a section material 57 bonded to the inner surface thereof and a biasing portion 58 fixed to the U-shaped wall. At a substantially central position in the blowoff orifice 30, a horizontal control plate 40 is provided both ends of which are swingably supported by the side plate 55 and the opposite side plate (not shown) and which has a vertical and horizontal rotary shaft in an air flowing direction. On the lower part of the blowoff orifice 30, a fluid guide plate 59 having a bending surface which is inclined downward as it goes downstream and whose longitudinal sectional surface is arc-shaped is attached to the side plates 55 (the opposite side is not shown). At the upstream end of the fluid guide 59, a damper 61 swingably supported on a supporting shaft 60 serving as a rotary shaft is provided. On the lower part of the heat exchanger 11, a bottom plate 62 on which a drain pan 90 made of a heat insulator is placed is provided, and on the downstream side of the drain pan 90, a fluid guide wall 63 is provided which has a bending surface inclined downward as it goes downstream. The fluid guide wall 63 and fluid guide plate 59 constitute an auxiliary blowoff orifice 50. The damper 61 is so adapted that it can open and close the auxiliary blowoff orifice 50. When the auxiliary blowoff orifice 50 is closed, the tip of the damper 61 abuts on the top of the fluid guide wall 63. The horizontal control plate 40 and the damper 61 are correlatively moved with each other so that when the horizontal control plate 40 swings downward, the damper 61 opens and when the former swings horizontally, the latter closes.

In the structure described above, at the time of horizontal blowoff, the horizontal control plate 40 is swung to be in a substantially horizontal position. Then, the damper 61 closes the auxiliary blowoff orifice 50 interlocking with the swing of the horizontal control plate 40 so that the jet flow above the horizontal control plate 40 is blown off horizontally and that below the horizontal control plate 40 flakes off from the bending surface of the fluid guide plate 59 to merge with the jet flow above the horizontal control plate 40. The flow thus merged is blown off horizontally.

At the time of downward blowoff, the horizontal control plate 40 is swung downward. Then, the damper 61 opens the auxiliary blowoff orifice 50 interlocking with the horizontal control plate 40. As a result, the jet flow below the horizontal control plate 40 is applied to the bending surface of the fluid guide plate 59 by the Coanda effect and deflected downward, and the jet flow above the horizontal control plate 40 is merged with that below the horizontal control plate 40 by attraction so that it is deflected downward to blow off. Further, the jet flow below the damper 61 is deflected downward by the fluid guide plate 59 and further deflected because of its application to the bending surface of the fluid guide wall 63 by the Coanda effect. After it goes out from the auxiliary blowoff orifice 50, it attracts the jet flow above the fluid plate 59, resulting in the blowoff deflected downward in a wide angle.

The drain pan 90 is molded by styrofoam, and held by plate metal so that it is fixed to the body.

Since thermal contraction occurs in a cooling operation, the drain pan 90 is deformed.

Because of the structure of the blowoff orifice as described above, at the time of horizontal blowoff, the jet flow below the horizontal control plate flakes off from the bending surface of the fluid guide plate. Therefore, condensation occurs on the fluid guide plate in the cooling operation and dew falls in the room.

The blowoff orifice cannot be closed by the horizontal control plate arranged at any position, and the auxiliary blowoff orifice appears always opened from the viewpoint of a user. This impairs the designing appearance of an air conditioner when it is not operated.

In addition, provision of the damper and auxiliary blowoff orifice increases the number of manufacturing steps such as molding and assembling in the fabrication process.

The conventional drain pan generates thermal contraction by heat exchange in the cooling operation, thus providing thermal deformation.

SUMMARY OF THE INVENTION

It is an object of the present invention to provide a blowoff orifice which has simple structure without using an auxiliary blowoff orifice equipped with a damper and can prevent condensation on a vertical wind deflecting plate and the blowoff orifice when these plates are set at any position, while maintaining the functions of downward and horizontal blowoff.

It is another object of the present invention to provide a blowoff orifice having a structure which can prevent a drain recovery device from being thermally deformed.

The blowoff orifice according to the present invention is comprised of: an upper wall inclined so that a flow passage becomes narrow toward downstream, the upper wall having a protrusion at an end portion thereof; a lower wall having a linear portion on the downstream side and an end portion forming an acute angle at the tip of the linear portion; and at least one vertical wind deflecting plate provided between the upper wall and the lower wall, the wind deflecting plate being capable of changing an airflow from a horizontal direction to a downward direction; wherein the upper wall protrusion is located more downstream than the lower wall end portion.

This blowoff orifice according to the present invention can applied to not only the ceiling hanging type air conditioner device, but can be applied to a wall-hanging type, a cassette type, a floor type, a ceiling embedded type, a built-in VAV unit (duct air conditioning blowoff type) of air conditioner, and an air cleaner, a dehumidifier, a humidifier, an exhaust fan, arrange hood, a cooled air fan, a freezing/refrigerator, a showcase, a gas/oil fan heater, a clean heater, and the like.

According to the present invention, during horizontal blowoff, the airflow having flowed along the upper wall at the upper part of the blowoff orifice is directed to the vertical wind deflecting plate by the protrusion at the end portion of the upper wall and flows along the vertical wind deflecting plate horizontally oriented so that it is not mixed with air outside the blowoff orifice. The airflow at the lower part goes straight along the linear portion of the lower wall and the acute angle portion at the tip of the lower wall surely separates the blown-off airflow from the air outside the blowoff orifice. Thus, the airflow in the horizontal direction can be surely obtained, and when cooled air is blown off from the blowoff orifice, condensation due to its mixing with air in a room does not occur at the wind deflecting plate and respective parts of the orifice. This makes it unnecessary to use sucking material.

During downward blowoff, the blown-off airflow is deflected downward by the protrusion of the upper wall and flows along the vertical wind deflecting plate without being separated therefrom. Thus, the downward airflow can be obtained and when cooled air is blown off, no condensation occurs on the vertical wind deflecting plate. Further, since the end portion of the lower end is located more upstream than the protrusion of the upper wall, an airflow can be smoothly formed downward so that the downward airflow can be surely obtained.

PREFERRED EMBODIMENTS OF THE INVENTION

Preferred embodiments of the present invention will be described as follows with reference to the accompanying drawings.

Embodiment 1

Figure 1:
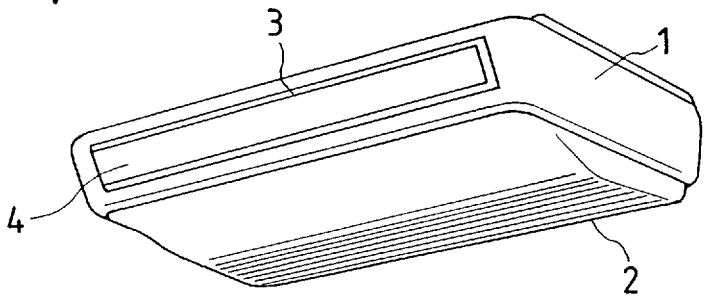
FIG. 1 is a perspective view of a ceiling hanging type air conditioner body showing one embodiment of the present invention.
Figure 2:
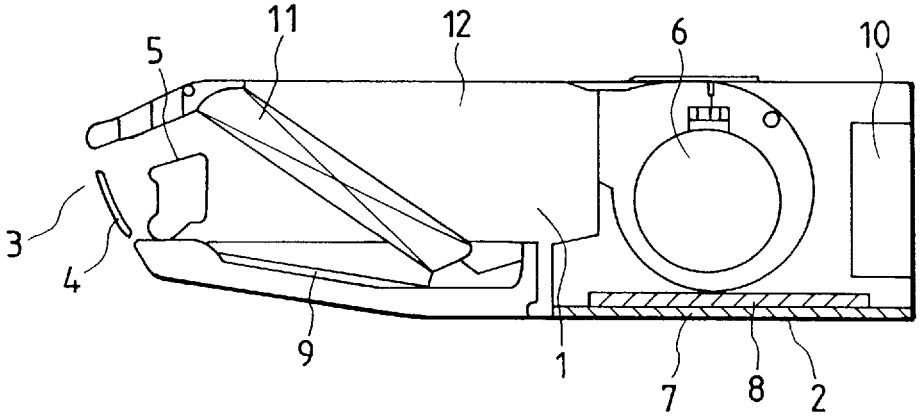
FIG. 2 is a perspective view of a ceiling hanging type air conditioner body showing one embodiment of the present invention.

FIG. 1 is a perspective view of the body of a ceiling-hanging type air conditioner according to the present invention. FIG. 2 is a sectional view thereof. This body is an interior machine of the air conditioner which is connected to an exterior machine (not shown) in which a compressor, an expansion valve, a heat exchanger, a blower, etc., are mounted to carry out air conditioning.

As shown in FIG. 2, the body includes a blower 6, a heat exchanger 11 and a control box 10. When the blower 6 operates, the indoor air taken from a sucking orifice 2 passes through the blower 6 and a wind passage 12 and heated or cooled by the heat exchanger 11 and supplied to an indoor room through a blowoff orifice 3. A sucking grill 7 and a filter 8 arranged in the sucking orifice 2 prevent dust in the room from flowing into the body. Dew produced in the heat exchanger when the heat exchanger is cooled is recovered by a drain water recovery plate 9 and discharged outdoors by a drain hose (not shown).

Figure 3:
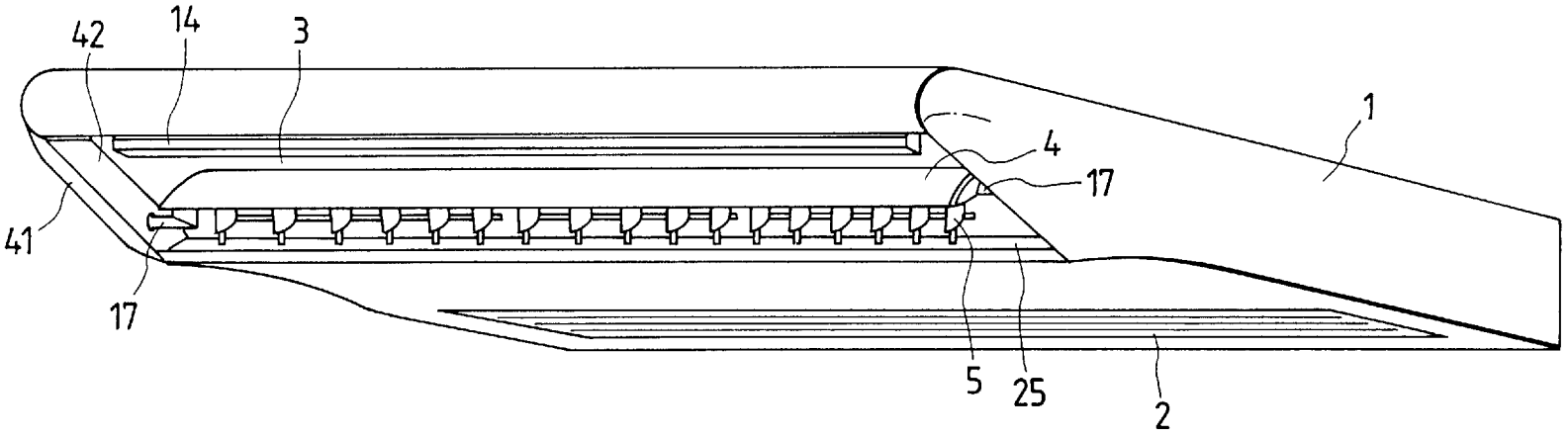
FIG. 3 is a perspective view of the detailed structure of a blowoff orifice of the ceiling hanging type air conditioner showing one embodiment of the present invention.

The detailed structure of the blowoff orifice in the ceiling-hanging type air conditioner is shown in FIG. 3. As shown in FIG. 3, the blowoff orifice 3 consists of an upper wall, a lower wall and side walls. The blowoff orifice 3 is provided with a vertical wind deflecting plate swingably supported by a rotary shaft 17 and a horizontal wind deflecting plate 5 so that blown-off airflow can be deflected in an optimum direction.

The control box 10 shown in FIG. 2 electrically carries out the control for the blower, vertical wind deflecting plate, etc., mutual control with the exterior machine and the transmission/reception control for a remote controller (not shown)

Figure 4:
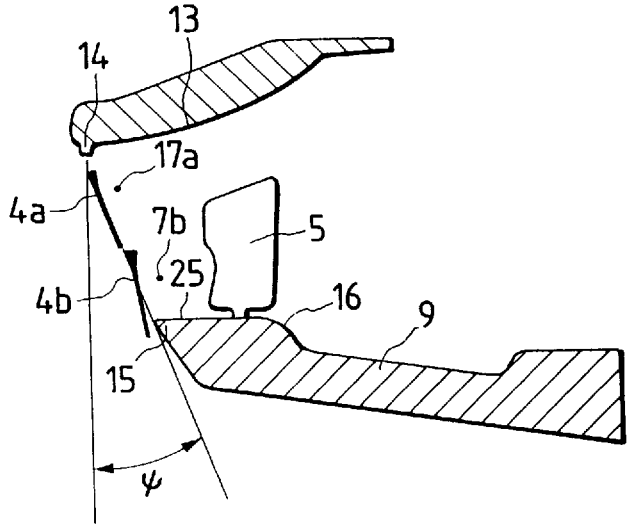
FIG. 4 is a sectional view of the blowoff orifice according to the first embodiment of the present invention during non-operation.

Referring to FIG. 4, the blowoff orifice party will be explained in detail. FIG. 4 is a sectional view of the blowoff orifice when the vertical wind deflecting plate 4 is at rest. In this embodiment, the vertical wind deflecting plate 4 includes two plates 4*a* and 4*b*.

The upper wall of the blowoff orifice has a curved surface 13 and a protrusion 14 at the tip.

The drain water recovery plate 9 constituting the lower wall of the blowoff orifice has an arc shape portion 16 on the front side and a linear portion 25 successive thereto. The tip 15 of the lower wall forms an acute angle.

The details of shapes and location of the upper wall and lower wall be explained later.

The operation of the vertical wind deflecting plates 4*a*, 4*b* will be explained. The vertical wind deflecting plates 4*a*, 4*b* swing about the rotary shafts 17*a*, 17*b*. When the vertical wind deflecting plates 4*a*, 4*b* are running, they rotate in a range from the position of horizontal blowoff in FIG. 5 to that of downward blowoff in FIG. 6. When the vertical wind deflecting plates 4*a* and 4*b* are at rest, it is at the position of FIG. 4. The vertical wind deflecting plates 4*a*, 4*b* at rest, which is arranged in a straight line or arc connecting the upper wall protrusion 14 to the lower wall tip 15, can substantially block air blowoff. Accordingly, when the air conditioner is at rest, the interior of the body cannot be seen from the blowoff orifice. The body, therefore, appears simple and beautiful to improve the designing appearance greatly. Further, the vertical wind deflecting plates thus arranged can also reduce invasion of dust into the body and eliminate countermeasure against condensation in the room. The rotary shaft 17*a*, 17*b* are rotated by a motor (not shown) attached to it so as to swing the vertical wind deflecting plates 4*a*, 4*b*. In this case, two plates 4*a*, 4*b* may be controlled by individual motors or a motor by a linkage mechanism.

Figure 5:
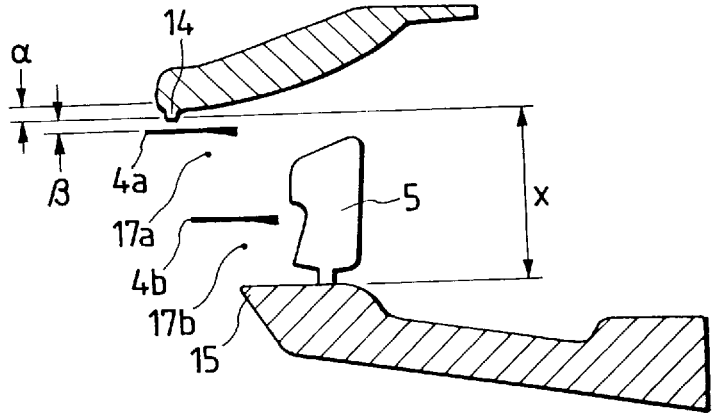
FIG. 5 is a sectional view of the blowoff orifice according to the first embodiment of the present invention during horizontal blowoff.
Figure 6:
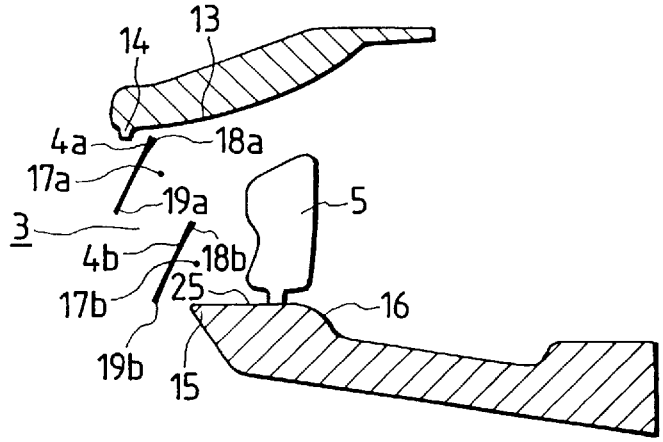
FIG. 6 is a sectional view of the blowoff orifice according to the first embodiment of the present invention during downward blowoff.

During operation, the vertical wind deflecting plates 4*a*, 4*b* can be stopped also between the positions of FIGS. 5 and 6 through remote control operation according to a use's will.

The shape of each of the upper wall and lower wall will be described in detail.

The protrusion 14 of the upper wall, when the vertical wind deflecting plates 4*a*, 4*b* are at the position shown in FIG. 5, provides an interval β between the vertical wind deflecting plate 4*a* and the tip of the protrusion. The optimum value of β, which depends on the speed of wind passing through this portion, amount of blowing wind, and the arrangement of the blower and heat exchanger, is 5–20% of the size (x in the figure) of an opening of the blowoff orifice.

The optimum height a of the protrusion 14, which should be a necessary and minimum value in order to suppress the pressure loss of the air in the blowoff orifice, is 5–10% of the size of an opening of the blowoff orifice, particulary in a case of dowing blowing as shown in FIG. 6. This is because in order to cause an airflow to flow along the vertical wind deflecting plate 4*a*, a downward vector must be produced to assure the flow speed to reach the vertical wind deflecting plate 4*a*.

The width of the protrusion 14 is basically equal to that of vertical wind deflecting plates 4*a*, 4*b* to prevent condensation on the vertical wind deflecting plates 4*a*, 4*b*, but may be slightly varied in a range enough to prevent the condensation. It may have a gap of 3.0–20 mm from both ends of the blowoff orifice as shown in FIG. 3. Since the wall edge of the blowoff orifice, where the wind speed is slow, is apt to involve the air in the room, the presence of the gap is effective to increase the wind speed so that the airflow flows along the wall, thereby preventing the condensation.

The protrusion 14 is located at the position more front than the tip 18*a* of the upper vertical wind deflecting plate 4*a* and more rear than the tip 19*a* on the opposite side.

The shape extending to the protrusion 14 may be an S-shape or arc curved shape or linear shape which makes the flow passage narrow as it goes downstream as shown in FIG. 6.

The tip 15 of the lower wall is located at the position (body side) more rear than the tip 19*b* of the vertical wind deflecting plate 4*b* on the lower wall side in FIG. 6.

The line extending from the protrusion 14 to the tip 15 of the lower wall forms an angle (ψ in FIG. 4) within 10° to 90° with a vertical line.

The portion 16 of the lower wall may be either linear or curve as long as the linear portion is provided in FIG. 6. If the drain water recovery plate is not required, a single surface may be provided.

The airflow around the blowoff orifice will be explained.

First, referring to FIG. 7, an explanation will be given of the horizontal blowoff.

The airflow at the upper portion of the blowoff orifice flows along the curved surface 13 is directed downward by the protrusion 14, and flows along the upper side of the vertical wind deflecting plate 4*a*. The wind passage forms a curve like the curved surface 13 so that the airflow flows with no bubbles generated there, thus preventing loss of the blowoff pressure from being increased. The protrusion 14 directs the airflow to the vertical wind deflecting plate 4*a* to form the horizontal airflow along the vertical wind direction plate 4*a*, thereby preventing the air (secondary air) in the room from flowing into the wind passage. Thus, the secondary air and blown-off air are mixed with each other so that cooling operation can be carried out with no condensation.

The airflow goes surely to the vertical wind deflecting plate 4*a*. Therefore, by maintaining the vertical wind deflecting plates 4*a*, 4*b* horizontally, the cooled air during the cooling is blown upwards in the room so that the room temperature can be reduced with a user not directly exposed to the cooled air. This greatly improves sense of comfort.

Figure 7:
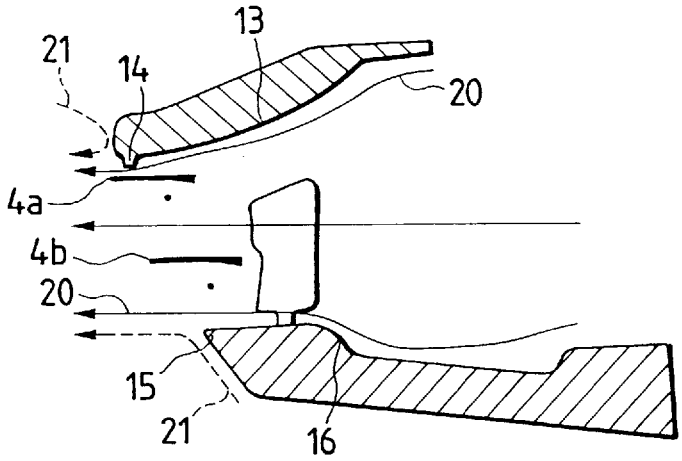
FIG. 7 is a schematic view of the airflow of the first embodiment of the present invention during horizontal blowoff.
Figure 8A:
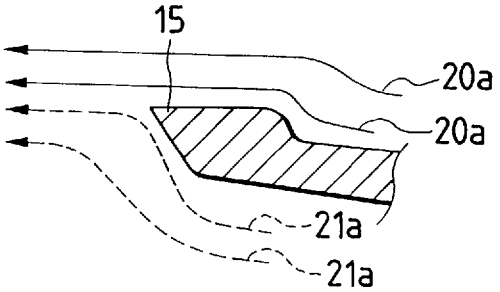
FIG. 8A is a schematic view of the airflow around the lower wall of the blowoff orifice according to the first embodiment of the present invention.
Figure 8B:
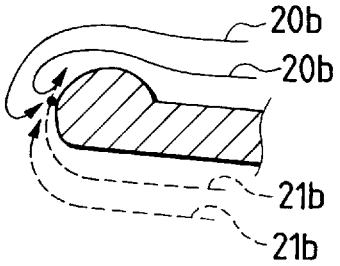
FIG. 8B is a schematic view of the airflow around the lower wall of the blowoff orifice to which the first embodiment is not applied.

The airflow on the lower side of the blowoff orifice flows along the curved face 16 and the linear segment 25 and goes straight into the room from the tip 15 (arrow 20 in FIG. 7). Then, as shown in FIG. 8A, the air in the room and the blown-off air are surely separated at the tip 15 of the blowoff orifice. If the tip forms a curved shape as shown in FIG. 8B, the blown-off air forms bubbles like 20*b* and is hence mixed with the air 21*b* in the room, thus providing condensation on the curved face or within the wind passage during cooling.

Accordingly, the upper and lower shapes of the blowoff orifice prevents condensation during cooling, necessitates no suction material and greatly reduces the production cost.

Figure 9A:
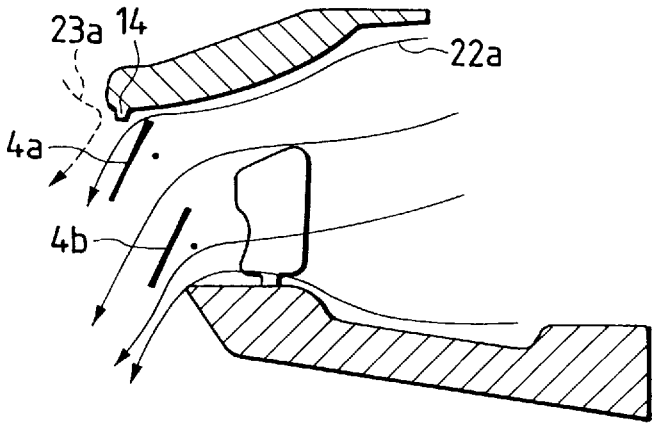
FIG. 9A is a schematic view of the airflow in the first embodiment during downward blowoff.
Figure 9B:
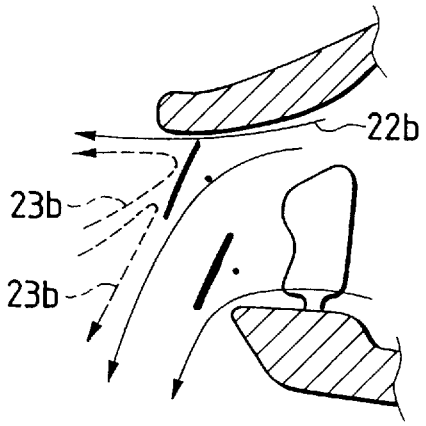
FIG. 9B is a schematic view of the airflow to which the first embodiment is not applied.

Referring to FIGS. 9A and 9B, an explanation will be given of the airflow during downward blowoff.

In FIG. 9A, the airflow passing the upper portion of the blowoff orifice is directed downward by the protrusion 14 at the tip of the blowoff orifice and flows along the upper face of the vertical wind deflecting plate 4*a* (see 22*a* in FIG. 9). Then, vertically overlapping the protrusion 14 the tip of the vertical wind deflecting plate 4*a* as shown in the figure promotes the above effect. With no protrusion, the airflow passing the upper side of the vertical wind deflecting plate 4*a* goes straight as shown in FIG. 9B. This reduces the amount of wind flowing downwards, thus leading to a disadvantage that the airflow does not reach the floor, particularly in home heating. In air-cooling, air in the room flows onto the upper surface of the vertical wind deflecting plate 4*a* (see 23*b* in FIG. 9) so that a temperature difference occurs between both sides of the vertical wind deflecting plate 4*a*, thus giving rise to condensation.

The present invention has solved the above two problems by passing the air both faces of the vertical wind deflection plate 4*a* using the protrusion 14 shown in FIG. 9.

The inclination within 10° to 90° (ψ in FIG. 4) of the protrusion 14 of the upper portion of the blowoff orifice and the tip 15 of the lower portion thereof makes it possible to cause more airflow to flow downward. This makes it possible to blow warm wind from the user's feet particularly during heating. Further, the tip of the upper wall is located more downstream than that of the lower wall so that the pressure loss at the time of downward blowoff is small enough to assure sufficient amount of wind and low noise.

When air is blown downward, as shown in FIG. 6, since the protrusion 14 on the upper wall is located more front than the tip 18*a* of the upper vertical wind deflecting plate 4*a* on the upper side and the tip on the lower wall is located more rear than the lower vertical wind deflecting plate 4*b*, the downward airflow can be easily produced, and hence assured.

The same effect as described above can be also obtained by the similar structure of the upper wall tip instead of the protrusion 14 on the upper wall.

Also in the case of one sheet of the vertical wind deflecting plate, the above relationship between the upper tip and lower tip of the vertical wind deflecting plate leads to the same effect.

In the above first embodiment, the blowoff orifice according to the present invention is applied to a ceiling hanging type air conditioner. The blowoff orifice according to the present invention is not limited to the ceiling hanging type air conditioner device, but may be applied to a wall-hanging type, a cassette type, a floor type, a ceiling embedded type, a built-in VAV unit (duct air conditioning blowoff type) of air conditioner, and an air cleaner, a dehumidifier, a humidifier, an exhaust fan, arrange hood, a cooled air fan, a freezing/refrigerator, a showcase, a gas/oil fan heater, a clean heater, etc.

It is of course that the blowoff orifice according to the second to sixth embodiments can be applied to a wide variety of devices.

Embodiment 2

Figure 10:
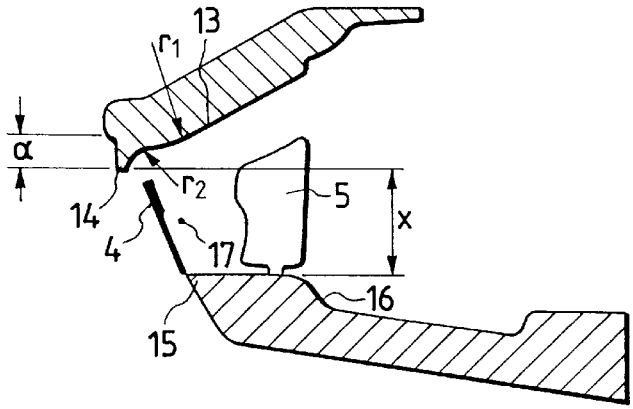
FIG. 10 is a sectional view of the blowoff orifice of the second embodiment during non-operation.

FIG. 10 is a sectional view showing the blowoff orifice during non-operation according to this embodiment. Referring to FIG. 10, an explanation will be given of an embodiment as to a single vertical wind deflecting plate 4.

Since this embodiment is the same as the first embodiment in the basic arrangement, operation and effect, only differences will be explained.

The optimum height (α in the figure) of protrusion 14 at the tip of the upper wall is 10–40% of the size (x in the figure) of an opening of the blowoff orifice. In the case of a single vertical wind deflecting plate, as compared to the case of double vertical wind deflecting plates, the distance between the upper wall and the upper surface of the vertical wind deflecting plate is long. Accordingly, the protrusion 14 is made relatively high.

Figure 11:
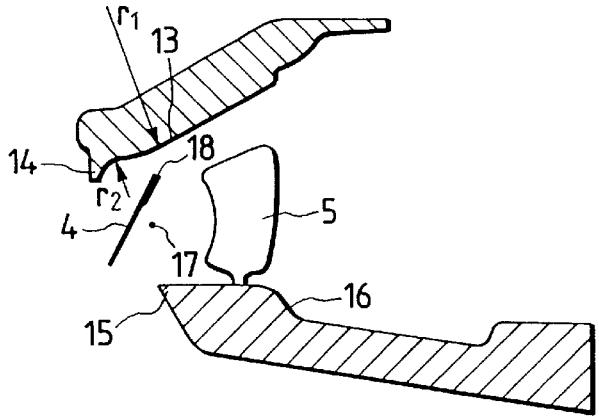
FIG. 11 is a sectional view of the blowoff orifice of the second embodiment during downward blowoff.

As shown in FIG. 11, in the case of downward blowoff, the angle of the vertical wind deflecting plate 4 and the size of the protrusion 14 are so set that the tip 18 of the vertical wind deflecting plate 4 is located at a position more upper than the tip of the protrusion 14. This configuration causes the airflow to flow surely along the upper surface of the vertical wind deflecting plate 4.

The curved portion 13 of the upper wall has radii r1 and r2 of curvature in an S-shape. The size of curvature is desired to be r1>r2. A small value of r1 results in abrupt squeezing of the flow passage, which increases pressure loss and reduces the amount of wind. A small value of r2 makes the protrusion 14 upright, thus giving the airflow a downward vector. In this embodiment, the ratio of r1 and r2 is 4:1. Incidentally, it is necessary that the relation of r1 and r2 should be r1>r2 in this case.

The effect of the horizontal blowoff is the same as in the first embodiment.

Figure 13:
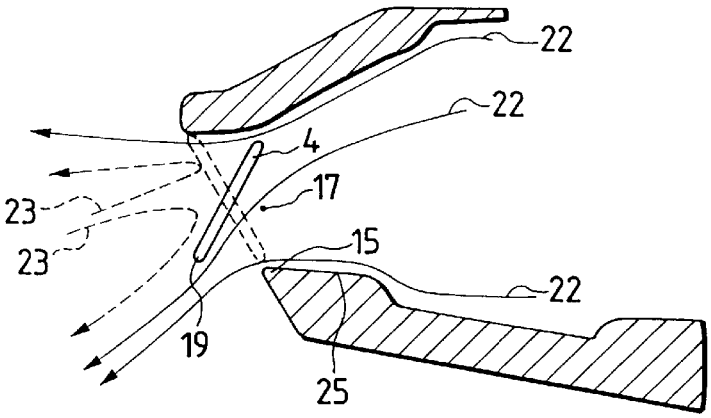
FIG. 13 is an explanation view of the airflow in the second embodiment of the present invention.

In the case of downward blowoff, with the upper wall having a shape as shown in FIG. 13, when the vertical wind deflecting plate 4 intends to close the blowoff orifice during non-operation in order to improve the designing appearance, the vertical wind deflecting plate 4 is large scaled, thereby increasing torque required for driving. Further, as described in connection with the first embodiment, in downward blowing, since the tip of the upper wall is more front than upper tip of the vertical wind deflecting plate and the tip of the lower wall is more rear than the lower tip of the vertical wind deflecting plate, FIG. 13 shows a configuration which is likely to make a downward airflow. In particular, where the vertical wind deflecting plate is single as in the configuration shown in FIG. 13, it is large-scaled. In the downward blowoff, therefore, the airflow 22 is separated from the vertical wind deflecting plate as in FIG. 13 so that the wind amount of the downward airflow is apt to be reduced, and particularly in home-heating, the airflow is hard to reach the floor. In cooling, since the air in the room is brought into contact with the upper surface of the vertical wind deflecting plate. This provides a temperature difference between both surfaces of the vertical wind deflecting plate, thus leading to condensation.

In order to solve these problems, the blown-off airflow must form a flow along the front surface of the vertical wind deflecting plate 4. Particularly, where the vertical wind deflecting plate 4 is single, since its size is large, the amount of airflow passing the upper surface of the vertical wind deflecting plate 4 must be increased. Where there is little airflow, the airflow must be separated on the way of the vertical wind deflecting plate 4.

Figure 12:
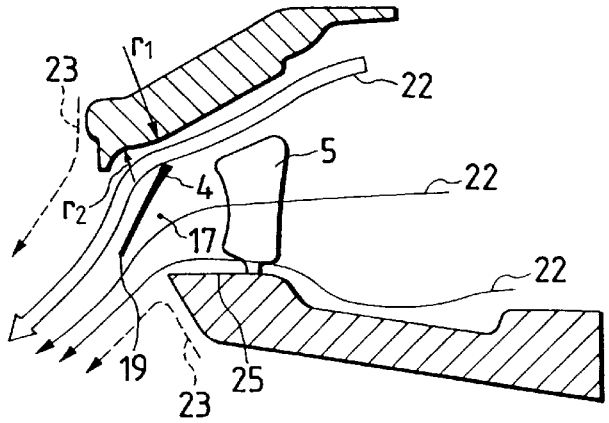
FIG. 12 is a sectional view of the airflow in the second embodiment of the present invention.

In this embodiment, as shown in FIG. 12, the upper wall in the form of an S-shape provides a long distance between the vertical wind deflecting plate 4 and the upper wall, thereby increasing the amount of wind passing the upper surface of the vertical wind deflecting plate 4. The protrusion 14 at the tip makes a downward flow so that the airflow along the vertical wind deflecting plate 4 is formed.

Thus, even where the vertical wind deflecting plate 4 is single, the amount of downward wind is assured, particularly, the airflow is caused to reach the floor in the room in home heating, thereby greatly improving sense of comfort. In addition, the orientation of the upper and lower walls and the vertical wind deflecting plate 4 can reduce pressure loss in the downward blowoff to assure the amount of wind and reduce noise.

Setting the vertical wind deflecting plate 4 at any angle from horizontal blowoff to downward blowoff does not lead to condensation on the vertical wind deflecting plate or wind passage. This necessitates water no sucking material, thus reducing the production cost.

In addition, for the purpose of substantially closing the discharge orifice during non-operation, the upper wall is provided with the protrusion 14 which is slightly larger than in the first embodiment so that the vertical wind deflecting plate 4 can be miniaturized. The horizontal blowoff and downward blowoff is formed by the shape of the upper wall and lower wall so that the designing appearance during non-operation is improved without deteriorating the inherent function.

Embodiment 3

This embodiment is directed to the case where the airflow is supplied more downward in the first and second embodiments and no condensation will be provided in cooling.

Figure 14:
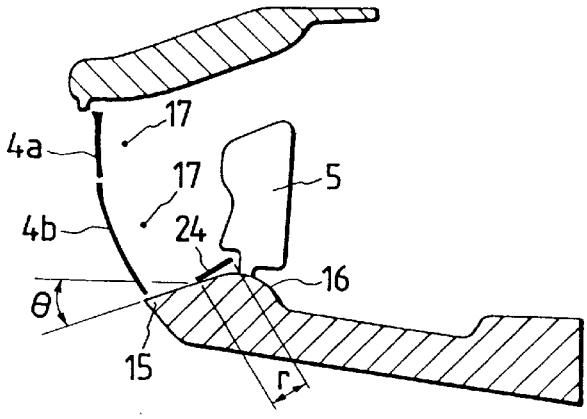
FIG. 14 is a sectional view of the blowoff orifice according to the third embodiment of the present invention during non-operation.

As shown in FIG. 14, the linear portion of the lower wall is set at an angle θ of 15° from the horizontal line towards the downstream side so as to be tangent to an arc 16. The preferable angle θ is from 7° to 20°. Further, as shown, a thin plate (hereinafter referred to as "rectifying plate") 24 made of plastic or metal is arranged at a position apart from the arc by 5–10 mm. In order to reduce the pressure loss of the blown-off wind, the plate must have the smallest thickness which is not deformed. The length of γ, which depends on the size of the installed blowoff orifice, may be 15 mm. The longitudinal length thereof is desired to be equal to that of the blowoff orifice. Incidentally, the inclination angle of the rectifying plate 24 with respect to the linear segment 25 is from 0° to 10°.

Figure 15:
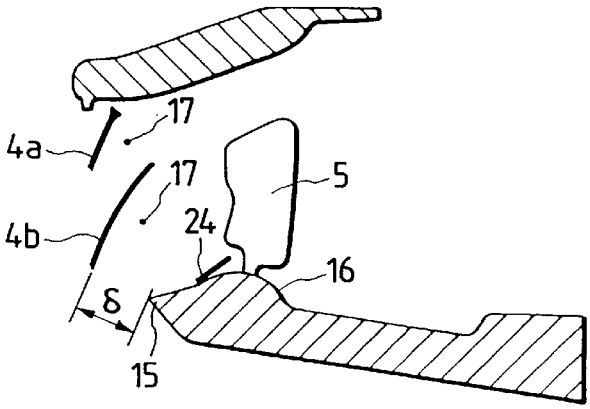
FIG. 15 is a sectional view of the blowoff orifice according to the third embodiment of the present invention during downward blowoff.
Figure 16A:
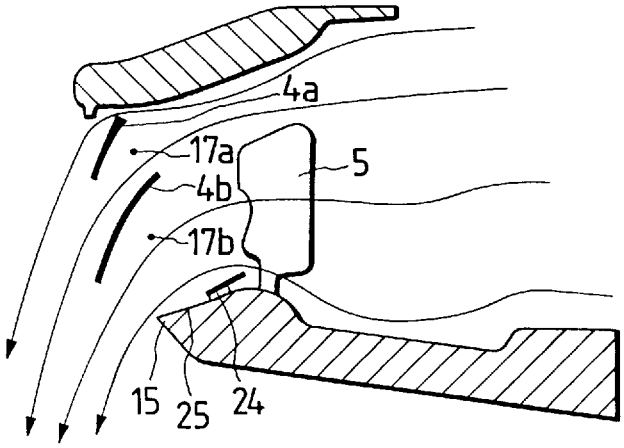
FIG. 16A is a schematic view of the airflow in the third embodiment of the present invention during downward blowoff.

As shown in FIG. 14, during non-operation, the vertical wind deflecting plates 4*a*, 4*b* are arranged to close the front surface of the blowoff orifice substantially. As shown in FIG. 15, during the downward blowoff, the vertical wind deflecting plate 4 swings to the position as shown. Then, the linear portion is more inclined than in the embodiments described above so that the distance of δ is increased. Since the pressure loss at this portion is low, the airflow is supplied downwards along the vertical wind deflecting plate 4*b* and inclined lower wall as shown in FIG. 16A.

Then, the airflow is guided so as to flow surely along the lower wall by the rectifying plate in parallel to the linear portion inclined downwards.

Figure 16B:
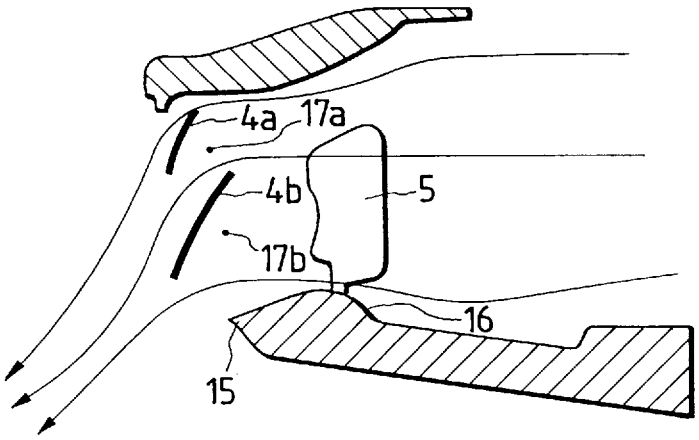
FIG. 16B is a schematic view of the airflow during downward blowoff to which the third embodiment is not applied.

With no rectifying plate, the airflow is separated on the lower wind deflecting plate 4*b* as shown in FIG. 16B and goes straight. As a result, the airflow deflected downward by the vertical wind deflecting plate 4*b* is pushed back.

In this way, since the shape 25 of the lower wall is inclined and the rectifying plate are arranged, the airflow can be blown more downward. In this embodiment, the blowing angle in the down direction in the case where the linear portion is horizontal is improved from 65° (in the first and second embodiments) to 70°.

An application of the blowoff orifice according to this embodiment to an air conditioner device permits the airflow to be blown to reach the floor. Particularly, in home-heating, a comfortable space of keeping the head cool and the feet warm can be formed.

Figure 17:
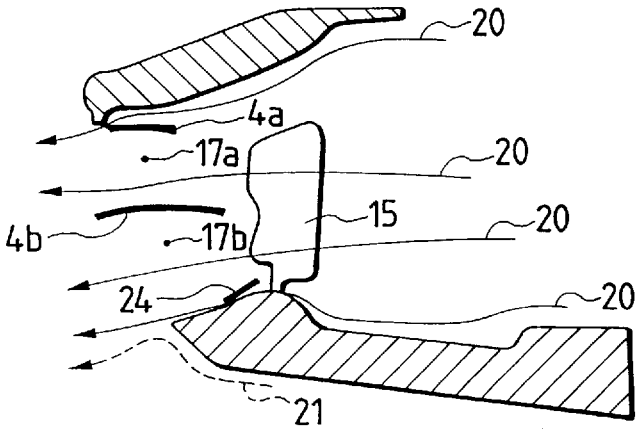
FIG. 17 is a schematic view of the airflow in the third embodiment of the present invention during horizontal blowoff.

During the horizontal blowoff, the airflow in the vicinity of the lower wall flows to spread as shown in FIG. 17. Because of the rectifying plate, the blown-off airflow flows also along the lower wall. No condensation during cooling occurs.

Incidentally, the linear portion of the lower wall is inclined by 15° or so from the horizontal line. If the angle is too large, during the horizontal blowoff, secondary air intrudes which is not preferable.

This embodiment, which has been explained on the case where the vertical wind deflecting plate 4 is double, has the same effect as in the case it is single.

Embodiment 4

This embodiment is an example for directing the airflow more downward.

When the blowoff orifice is substantially closed during non-operation stopping as shown in FIG. 10, during the downward blowoff as shown in FIG. 12, the vertical wind deflecting plate 4 swings so that its tip is located more upper than the horizontal linear portion 25 of the lower wall.

The airflow goes straight as indicated by an arrow and pushes back the downward airflow along the vertical wind deflecting plate 4.

Figure 18:
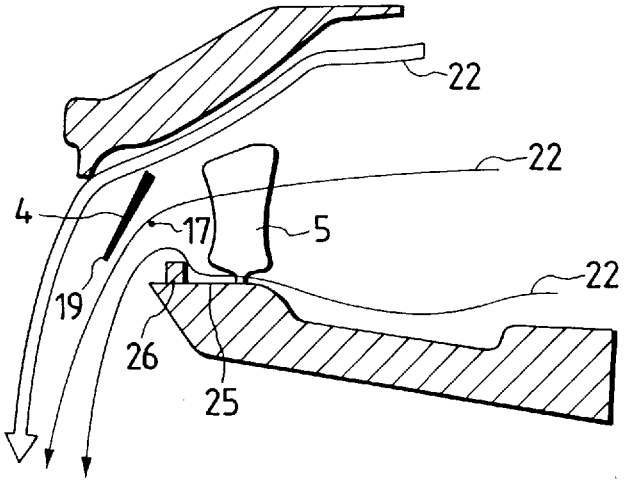
FIG. 18 is a sectional view of the blowoff orifice and a schematic view of the blowoff orifice in the fourth embodiment of the present invention during downward blowoff.

Since a protrusion 26 is provided on the linear portion of the lower wall as shown in FIG. 18 in order to direct the airflow in the vicinity of the lower wall once upward and direct it downward again by the vertical wind deflecting plate 4, the airflow is greatly deflected downward to flow without being pushed back. The tip of the vertical wind deflecting plate 4 should be located above or be flush with the tip of the vertical wind deflecting plate 4. In this embodiment, the blowing angle in the case where the linear portion is horizontal is improved from 65° (in the first and second embodiments) to 70°.

Thus, since the airflow can be directed greatly downward, the body installed at a high position permits the airflow to be blown to reach the floor. Particularly, in home heating, comfort can be improved.

In accordance with this embodiment, as in the embodiments described above, during non-operation the designing appearance is not impaired, and during cooling, no condensation occurs at any installation of the vertical wind deflecting plate, thus necessitating no sucking material.

Embodiment 5

Figure 19:
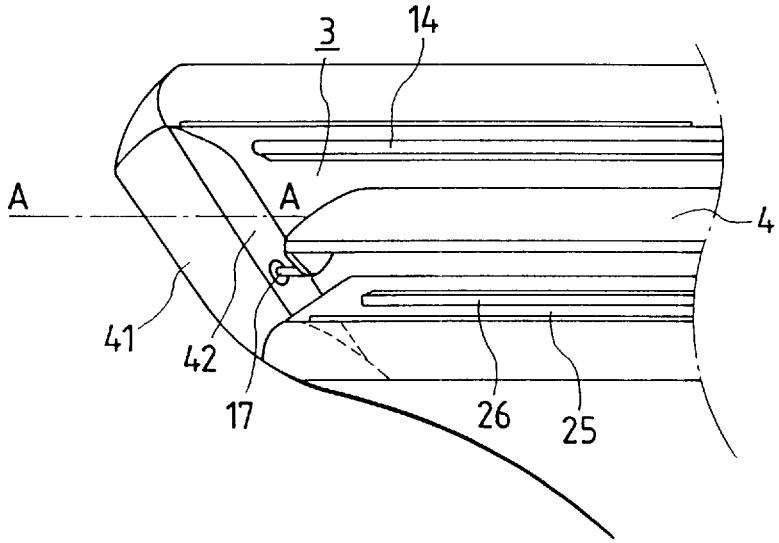
FIG. 19 is a perspective view of the end of the blowoff orifice according to the fifth embodiment of the present invention.

An explanation will be given of the shape of the right and left ends of the blowoff orifice. FIG. 19 is a perspective view of the left end of the blowoff orifice according to this embodiment. The horizontal wind deflecting plate is not shown. Protrusions are formed on the upper and lower walls, and the vertical wind deflecting plate is swingably supported by a rotary shaft 17.

Figure 20:
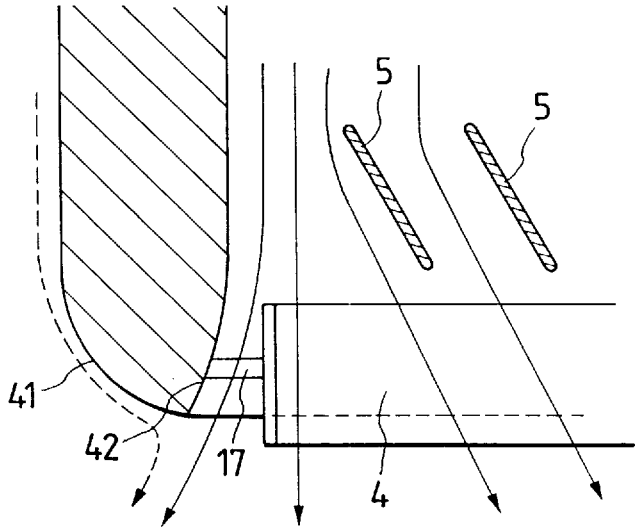
FIG. 20 is a sectional view taken along line A—A in FIG. 19.

FIG. 20 is a section view of A—A section in FIG. 19. In this drawing, reference numeral 5 designates a horizontal wind deflecting plate. The shape of the left end is composed of a small arc of an outside wall 41 and a large arc of a blowoff orifice side wall 42. The connecting portion has an edged shape. The blowoff orifice side 42 may be linear and may not be a shape expanding the wind passage. The vertical wind deflecting plate 4 and the left end of each of the protrusions are desired to be apart by 0 to 20 mm from the left end wall. This applies to the rectifying plate.

The airflow will be explained below. Now it is assumed that the horizontal wind deflecting plate 5 is inclined in a direction opposite to the left wall as shown in the drawing. The airflow flows along the left wall while it spreads. The blown-off airflow flows along the wall in the vicinity of the wall by the Coanda effect, goes straight from the edge portion, and flows into a room space. Then, the room air flows along the outside of the left wall. Then, the room air flows along the outside of the left wall, but the blown-off airflow is not mixed with the room air flow since the flowing speed of the blown-off airflow is high, and goes forwards from the edge portion. If the blowoff orifice side wall 42 is formed of a small arc, the blown-off airflow will be separated from the wall because of the speed and mixed with the room air. The outside wall 41 may have the shape with any size as long as the room air at a low speed is not separated, but in many cases, it has a small arc considering the designing appearance.

As an application of this embodiment, the left end of the blowoff orifice may be provided with a protrusion 43 at the end tip to provide the same effect. The protrusion 43 may be integrally molded or bent as a separate piece.

If the vertical wind deflecting plate 4 and the left end of each of the protrusions on the upper and lower walls are arranged apart from the left end wall, the amount of wind flowing along the end portion increases so that mixing of the blown-off airflow with the room air can be suppressed more greatly.

Figure 21:
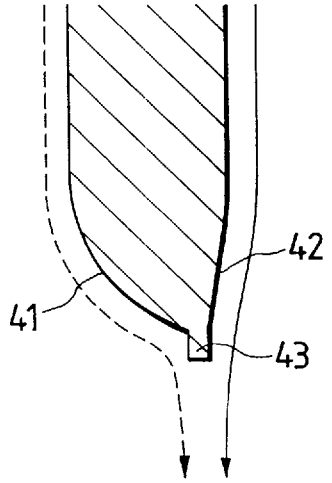
FIG. 21 is a sectional view of the end of another blowoff orifice according to the fifth embodiment of the present invention.

The right side may have a shape symmetrical to that in FIGS. 20 and 21.

Thus, since the amount of the blown-off airflow at the right and left walls is increased and mixing of the blown-off airflow and room air is prevented by the shape of the wall, condensation at the end of the blowoff orifice during cooling and humidification can be prevented, thereby necessitating no sucking material and reducing the production cost.

Embodiment 6

Figure 22:
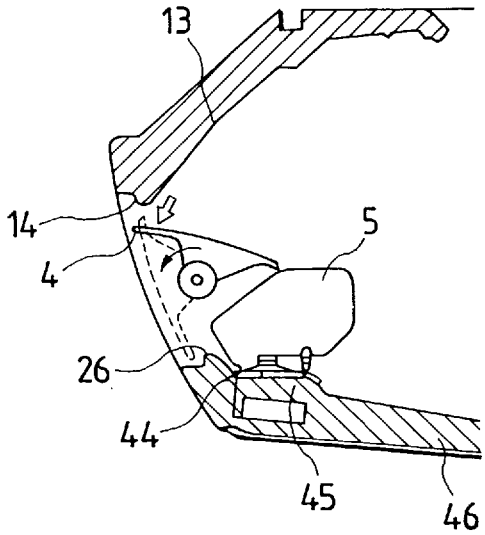
FIG. 22 is a sectional view of a drain recovery device according to the sixth embodiment of the present invention.
Figure 23:
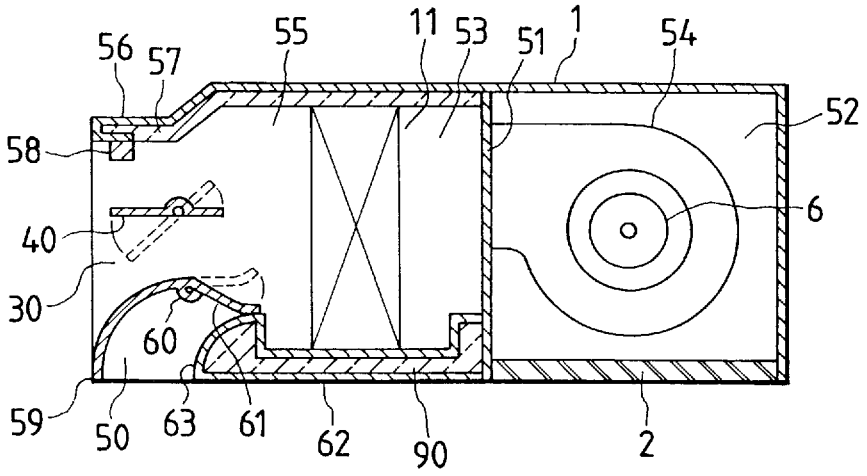
FIG. 23 is a sectional view of a conventional ceiling hanging type air conditioner body.

FIG. 22 is a sectional view of the blowoff orifice according to this embodiment.

In FIG. 22, reference numeral 46 denotes a drain recovery device of styrofoam which constitutes the lower wall of the blowoff orifice. The drain recovery device 46 is constructed in such a manner that an attachment plate 45 for a horizontal wind deflecting plate holder 44 is integrally insertion-molded and the horizontal wind deflecting plate holder 44 is bolted to or hung on the attachment plate 45.

In the structure according to this embodiment, the horizontal wind deflecting holder attachment 45 serving as a reinforcement material is embedded in the substantially entire area in a longitudinal direction of the drain recovery device. For this reason, the drain recovery device which has produced thermal contraction during cooling running can surely maintain the present form without being deformed because of embedding of the reinforcement material.

In the blowoff orifice according to the present invention, during horizontal blowoff, the airflow having flowed along the upper wall at the upper part of the blowoff orifice is directed to the vertical wind deflecting plate by the protrusion at the end portion of the upper wall and flows along the vertical wind deflecting plate horizontally oriented so that it is not mixed with air outside the blowoff orifice. The airflow at the lower part goes straight along the linear portion of the lower wall and the acute angle portion at the tip of the lower wall surely separates the blown-off airflow from the air outside the blowoff orifice. Thus, the airflow in the horizontal direction can be surely obtained, and when cooled air is blown off from the blowoff orifice, condensation due to its mixing with air in a room does not occur at the wind deflecting plate and respective parts of the orifice. This makes it unnecessary to use sucking material.

During downward blowoff, the blown-off airflow is deflected downward by the protrusion of the upper wall and flows along the vertical wind deflecting plate without being separated therefrom. Thus, the downward airflow can be obtained and when cooled air is blown off, no condensation occurs on the vertical wind deflecting plate. Further, since the end portion of the lower end is located more upstream than the protrusion of the upper wall, an airflow can be smoothly formed downward so that the downward airflow can be surely obtained.

In the blowoff orifice according to the present invention, the linear portion of the lower wall is inclined downward toward downstream and a rectifying plate is arranged in the vicinity of the lower wall, the airflow rectified by the rectifying plate during the downward blowoff has a downward vector and flows along the inclined linear portion of the lower wall. Thus, it does not obstruct and merges with the airflow deflected downward by the vertical wind deflecting plate. For this reason, as compared with the first blowoff orifice, the airflow can be blown more downward so that the airflow can be blown toward immediately below the blowoff orifice.

In the blowoff orifice according to the present invention, the same downward airflow as in the second blowoff orifice is obtained in such a manner that the airflow in the vicinity of the lower wall is once directed upward in a control range of the vertical wind deflection plate by the protrusion provided at the horizontal linear portion of the lower wall, and then is directed downward to merge with the airflow from above without obstructing it.

Such a manner permits the airflow to be blown immediately below the blowoff orifice without increasing the number of components.

The blowoff orifice according to the present invention, in which when the airflow is blown off downward by the vertical wind deflecting plate, the end portion of said vertical wind deflecting plate nearest to the upper wall is located more upstream than the protrusion of said upper wall and that of said vertical wind deflecting plate nearest to the lower wall is located more downstream than the end portion of said lower wall, in addition to the effects of the invention described above, permits the downward airflow to be easily formed and assured more surely.

The blowoff orifice according to the present invention, which is structured to be substantially closed during non-operation, in addition to the effects of the invention described above, can prevent dust from invading an orifice body during non-operation and improve the designing appearance without impairing the function of the orifice.

In the present invention, since an air conditioner is provided with the blowoff orifice defined above, during cooling, condensation at the respective parts is prevented, and during home-heating, sufficient downward airflow is obtained to reach the floor so that a comfortable space of keeping the head cool and the feet warm can be formed.

The blowoff orifice according to the present invention has a structure that it comprises an upper wall, a lower wall, and a vertical wind deflecting plate provided between said upper wall and said lower wall and capable of changing an airflow from a horizontal direction to a downward direction, and an end portion of said upper wall is located more downstream than an end portion of said lower wall, and when the airflow is blown off downward by the vertical wind deflecting plate, the end portion of said vertical wind deflecting plate nearest to the upper wall is located more upstream than the end portion of said upper wall and that of said vertical wind deflecting plate nearest to the lower wall is located more downstream than the end portion of said lower wall. For this reason, a downward airflow can be easily produced so that the downward airflow can be assured. In addition, the blowoff orifice has also a structure that the wind passage resistance in a blowoff direction when an airflow is blown downward can be suppressed so that reduction in wind amount during downward blowoff and sound of wind blowing can be suppressed.

The blowoff orifice according to the present invention has a structure in which a protrusion is provided at the end potion of the upper wall. For this reason, in addition to the effect of the invention described above, during horizontal blowoff, the airflow having flowed along the upper wall at the upper part of the blowoff orifice is directed to the vertical wind deflecting plate by the protrusion at the end portion of the upper wall and flows along the vertical wind deflecting plate horizontally oriented so that it is not mixed with air outside the blowoff orifice. Thus, the airflow in the horizontal direction can be surely obtained, and when cooled air is blown off from the blowoff orifice, condensation due to its mixing with air in a room does not occur at the wind deflecting plate and respective parts of the orifice. This makes it unnecessary to use sucking material.

During downward blowoff, the blown-off airflow is deflected downward by the protrusion of the upper wall and flows along the vertical wind deflecting plate without being separated therefrom, Thus, the downward airflow can be obtained and when cooled air is blown off, no condensation occurs on the vertical wind deflecting plate.

The blowoff orifice according to the invention has a structure that in the invention, the lower wall has a horizontal linear portion and an end portion with an acute angle. For this reason, in addition to the effects of the above inventions, during the horizontal blowoff, the airflow at the lower part goes straight along the linear portion of the lower wall and the acute angle portion at the tip of the lower wall surely separates the blown-off airflow from the air outside the blowoff orifice. Thus, the airflow in the horizontal direction can be surely obtained, and when cooled air is blown off from the blowoff orifice, condensation due to its mixing with air outside the blowoff orifice can be prevented on the lower part of the orifice. This makes it unnecessary to use sucking material and others.

The air conditioner according to the invention is provided with a blowoff orifice defined by the invention. For this reason, during cooling, condensation at the respective parts can be prevented, thus making it unnecessary to use sucking material and others.

The sufficient downward airflow can be obtained and particularly in home-heating, comfortable environment can be obtained.

The invention has a structure in which the front surfaces of right and left ends of said blowoff orifice are formed in two arc shapes in such a way that the front surface on the side of the blowoff orifice is formed in a large arc shape or linear shape, the external front surface of an orifice body is formed in a small arc shape and a portion connecting these arc shapes is edge-shaped. For this reason, the blown-off air is not separated from the wall but goes forward from the edge-shaped portion. Thus, it does not merge with air in a room at the right and left ends of the blowoff orifice so that condensation during cooling can be prevented there, thus making it unnecessary to use sucking material and others.

In the invention, the lower wall of the lower wall is formed of a drain recovery device made of synthetic resin in which a reinforcement material serving as a component attachment stand is embedded. For this reason, thermal deformation of a drain pan can be prevented, thus improving reliability. Since the reinforcement member serves as a component attachment stand, for example, a horizontal wind deflecting plate and others can be easily attached.

What is claimed is:

1. A blowoff orifice comprising:

an upper wall inclined so that a flow passage becomes narrow toward downstream, said upper wall having a protrusion at an end portion thereof;

a lower wall having a linear portion on the downstream side and an end portion forming an acute angle at the tip of said linear portion; and a vertical wind deflecting plate provided between said upper wall and said lower wall, said vertical wind deflecting plate being changeable of an airflow from a horizontal direction to a downward direction;

wherein said protrusion is located more downstream than the end portion of said lower wall.

2. A blowoff orifice according to claim 1, further comprising a rectifying plate arranged in a vicinity of said lower wall;

wherein said linear portion is inclined toward the downstream.

3. A blowoff orifice according to claim 1, wherein said end portion of said lower wall has a protrusion.

4. A blowoff orifice according to claim 1, wherein a plurality of said vertical wind deflecting plate are provided.

5. A blowoff orifice according to claim 1, wherein when an airflow is blown off downward by said vertical wind deflecting plate, the end portion of said vertical wind deflecting plate is located more upstream than said protrusion of said upper wall and the end portion of said vertical wind deflecting plate nearest to the lower wall is located more downstream than the end portion of said lower wall.

6. A blowoff orifice according to claim 4, wherein when an airflow is blown off downward by the vertical wind deflecting plate, an end portion of one of said plurality of vertical wind deflecting plates nearest to said upper wall is located more upstream than the protrusion of said upper wall and an end portion of one of said plurality of vertical wind deflecting plates nearest to said lower wall is located more downstream than the end portion of said lower wall.

7. A blowoff orifice according to claim 1, wherein said vertical wind deflection plate has a shape which substantially closes the blowoff orifice at a predetermined position.

8. A blowoff orifice according to claim 2, wherein said vertical wind deflection plate has a shape which substantially closes the blowoff orifice at a predetermined position.

9. A blowoff orifice according to claim 3, wherein said vertical wind deflection plate has a shape which substantially closes the blowoff orifice at a predetermined position.

10. A blowoff orifice according to claim 4, wherein when said vertical wind deflection plate is in a horizontal direction, an interval between said vertical wind deflecting plate and the tip of said protrusion is in the range of 5 to 20% of the size of an opening of said blowoff orifice.

11. A blowoff orifice according to claim 4, wherein a height of said protrusion is in the range of 5 to 10% of the size of an opening of said blowoff orifice.

12. A blowoff orifice according to claim 4, wherein a line extending from said protrusion to the tip of said lower wall forms an angle of 10° or more with a vertical line.

13. A blowoff orifice according to claim 1, wherein a height of said protrusion is in the range of 10 to 40% of the size of an opening of said blowoff orifice.

14. A blowoff orifice according to claim 2, wherein said rectifying plate is in parallel to said linear portion.

15. A blowoff orifice according to claim 1, wherein said linear portion is horizontal.

16. A blowoff orifice comprising:

an upper wall;

a lower wall; and a vertical wind deflecting plate provided between said upper wall and said lower wall, said vertical wind deflecting plate being changeable of an airflow from a horizontal direction to a downward direction;

wherein an end portion of said upper wall is located more downstream than an end portion of said lower wall, and when the airflow is blown off downward by the vertical wind deflecting plate, the end portion of said vertical wind deflecting plate nearest to the upper wall is located more upstream than the end portion of said upper wall and the end portion of said vertical wind deflecting plate nearest to the lower wall is located more downstream than the end portion of said lower wall and the end portion of said upper wall.

17. A blowoff orifice comprising:

an upper wall;

a lower wall; and a vertical wind deflecting plate provided between said upper wall and said lower wall, said vertical wind deflecting plate being changeable of an airflow from a horizontal direction to a downward direction;

wherein an end portion of said upper wall is located more downstream than an end portion of said lower wall, and when the airflow is blown off downward by the vertical wind deflecting plate the end portion of said vertical wind deflecting plate nearest to the upper wall is located more upstream than the end portion of said upper wall and the end portion of said vertical wind deflecting plate nearest to the lower wall is located more downstream than the end portion of said lower wall, wherein said upper wall is inclined so that a flow passage becomes narrow toward downstream and provided with a protrusion at its end portion.

18. A blowoff orifice comprising:

an upper wall;

a lower wall; and a vertical wind deflecting plate provided between said upper wall and said lower wall, said vertical wind deflecting plate being changeable of an airflow from a horizontal direction to a downward direction;

wherein an end portion of said upper wall is located more downstream than an end portion of said lower wall, and when the airflow is blown off downward by the vertical wind deflecting plate, the end portion of said vertical wind deflecting plate nearest to the upper wall is located more upstream than the end portion of said upper wall and the end portion of said vertical wind deflecting plate nearest to the lower wall is located more downstream than the end portion of said lower wall, wherein said lower wall has a horizontal linear portion downstream and an end portion forming an acute angle at the tip of said linear portion.

19. A blowoff orifice according to claim 17, wherein said lower wall has a horizontal linear portion downstream and an end portion forming an acute angle at the tip of said linear portion.

20. A blowoff orifice comprising:

an upper wall;

a lower wall; and a vertical wind deflecting plate provided between said upper wall and said lower wall, said vertical wind deflecting plate being changeable of an airflow from a horizontal direction to a downward direction;

wherein an end portion of said upper wall is located more downstream than an end portion of said lower wall, and when the airflow is blown off downward by the vertical wind deflecting plate, the end portion of said vertical wind deflecting plate nearest to the upper wall is located more upstream than the end portion of said upper wall and the end portion of said vertical wind deflecting plate nearest to the lower wall is located more downstream than the end portion of said lower wall, wherein a front surfaces of right and left ends of said blowoff orifice are formed in such a way that the front surface on the side of the blowoff orifice is formed in a large arc shape or linear shape, the external front surface of an orifice body is formed in a small arc shape and a portion connecting these arc shapes is edge-shaped.

* * * * *